United States Patent [19]

Brownlee

[11] 4,423,915

[45] Jan. 3, 1984

[54] LAMP SOCKET

[75] Inventor: Robert C. Brownlee, Fenton, Mich.

[73] Assignee: Chrysler Corporation, Highland Park, Mich.

[21] Appl. No.: 350,704

[22] Filed: Feb. 22, 1982

[51] Int. Cl.[3] ..... H01R 33/48

[52] U.S. Cl. ..... 339/32 R; 339/88 R

[58] Field of Search ..... 339/176 L, 177 L, 182 L, 339/184 L, 189 L, 191 L, 188 R, 195 L, 32, 33, 88; 403/349, 353; 29/150

[56] References Cited

U.S. PATENT DOCUMENTS

| | | | |
|---|---|---|---|
| 834,462 | 10/1906 | Faught | 29/150 |
| 3,982,808 | 9/1976 | Marechal | 339/88 R |
| 4,099,820 | 7/1978 | De Lano | 339/88 R |

FOREIGN PATENT DOCUMENTS

| | | | |
|---|---|---|---|
| 1117748 | 11/1961 | Fed. Rep. of Germany | 339/32 R |
| 2006291 | 7/1977 | Fed. Rep. of Germany | 339/88 R |

*Primary Examiner*—Joseph H. McGlynn
*Assistant Examiner*—David L. Pirlot
*Attorney, Agent, or Firm*—Newtson and Dundas

[57] ABSTRACT

This disclosure pertains to quick insertion type lamp sockets. The sockets are for supporting light bulbs having a circular base with retention pins radially projecting from either side of the circular base. One type of bulb which the present socket can receive and support has diametrically opposed and axially aligned pins radially projecting on its circular base. A second type of bulb which the present socket can receive and support has diametrically opposed and axially offset pins on its circular base. The base of the subject socket has opening means located and configured so as to positively engage and axially restrain both pins of either the first or second bulb type.

3 Claims, 4 Drawing Figures

LAMP SOCKET

BACKGROUND AND SUMMARY OF THE INVENTION

Previous types of sockets have been designed and used to accept lamps with a single terminal and to accept lamps with two terminals. An example is U.S. Pat. No. 4,099,820. In accordance with the present invention a lamp socket is constructed which will receive single or multi-terminal lamps and axially restrain each pin on the lamp base. More specifically, the invention pertains to two sets of diametrically disposed J-slots, one set is even and one set is odd. The even set of J-slots accepts radially projecting, axially aligned pins on the base of a first lamp when the lamp base is inserted into the socket and turned clockwise. The odd set of J-slots commonly shares its entrance portion with the even set of J-slots. The seating portions of the odd J-slots are offset axially from one another and accepts radially projecting, axially offset pins on the base of a second lamp when the lamp base is inserted into the socket and turned counterclockwise. Regardless of the pin alignment both pins are supported and thereby retain the bulb within the socket.

One of the primary objects of the present invention is to provide a lamp socket which will receive single or multi-terminal light bulbs and axially restrain each pin on the lamp base, thereby reducing the possibility of bulb movement once the bulb is seated in the socket.

Other objects and advantage of this invention will be made apparent as the description progresses.

BRIEF DESCRIPTION OF THE DRAWINGS

In the accompanying drawings in which one of several possible embodiments of the invention are illustrated.

Like parts are shown by corresponding reference characters throughout the several views of the drawings.

DESCRIPTION OF THE PREFERRED EMBODIMENT

Figure 1:
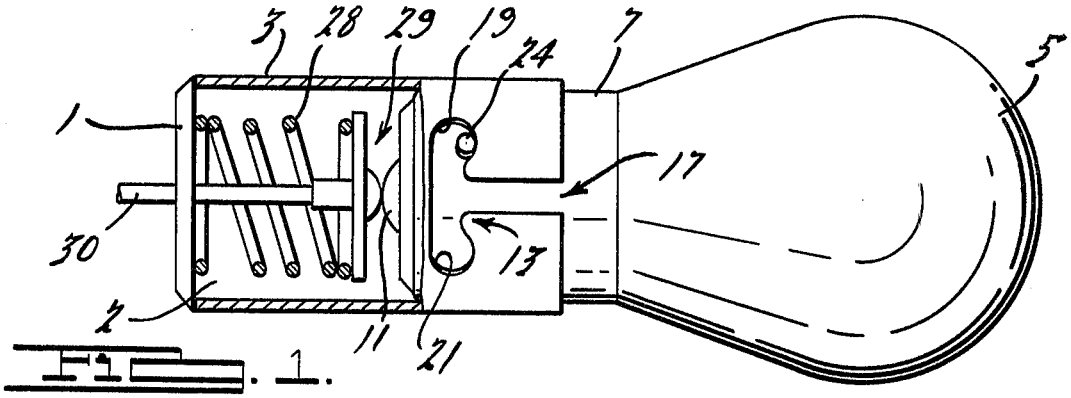
FIG. 1 is a left side sectional view of the subject socket accepting a light bulb with an even pin configuration into a set of even J-slots.

Referring now to the drawings, a lamp socket 3 is constructed in accordance with the present invention to accommodate light bulbs of the even J-slot or odd J-slot type. The lamp socket 3 comprises a metallic or nonmetallic sleeve having an end stop means 1 at one end thereof and an opening at the other end of the sleeve. J-slots 13 and 15 are cut or drawn or molded in the sleeve wall and are defined in part by axially extending slot entrance portions 17 and 18 disposed in diametrically opposed relation.

The slots 13 and 15 have enlarged seating portions 19, 20, 21 and 22 to provide seats for the bulb retention pins 24, 25, 26, 27. Bulb retention seating portions 19, 20 and 21 are axially aligned. Bulb retention seating portion 22 is axially offset toward the open end of the socket from seating portions 19, 20 and 21.

Figure 2:
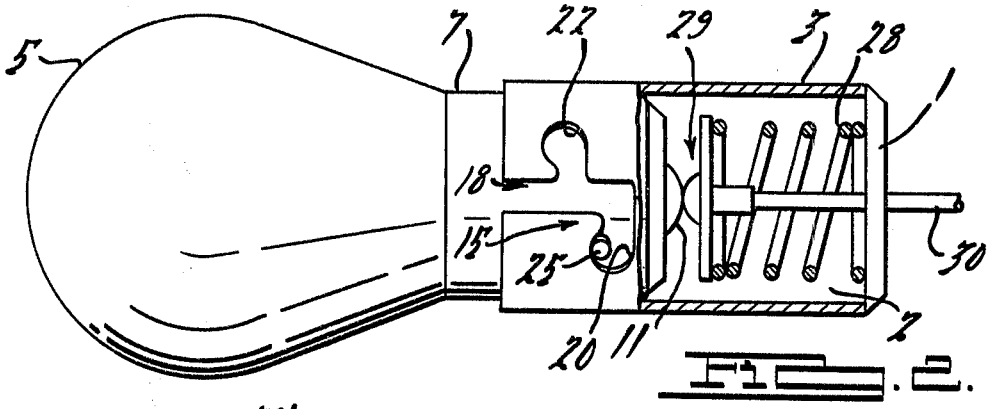
FIG. 2 is a right side sectional view of the subject socket accepting the light bulb with an even pin configuration shown in FIG. 1 into a set of even J-slots.

The even set of J-slots are defined by entrance portions 17 and 18 and seating portions 19 and 20 in FIGS. 1 and 2 such that a conventional J-slot is formed thereby. The even set of J-slots accepts radially projecting, axially aligned bulb retention pins 24 and 25 on the light bulb base 7. When the light bulb base 7 is inserted into the socket 3 and turned clockwise such that the pins 24 and 25 rest in the seating portions 19 and 20, respectively.

Figure 3:
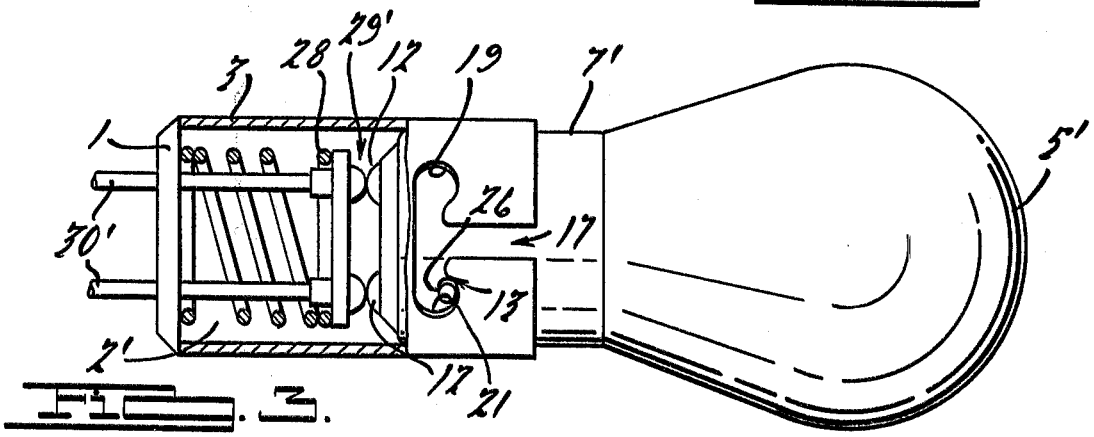
FIG. 3 is a left side sectional view of the subject socket accepting a light bulb with an odd pin configuration into a set of odd J-slots.
Figure 4:
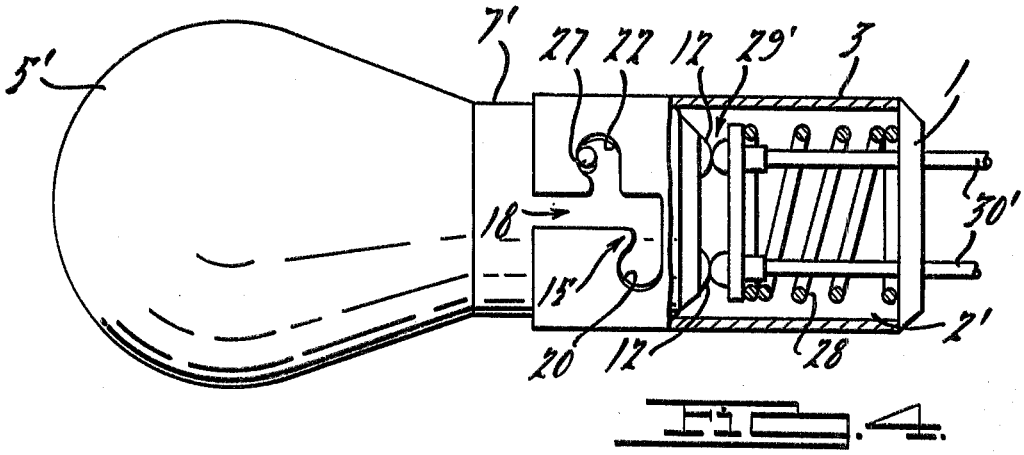
FIG. 4 is a right side sectional view of the subject socket accepting the light bulb with an odd pin configuration shown in FIG. 3 into a set of odd J-slots.

The odd set of J-slots are defined by entrance portions 17 and 18 and seating portions 21 and 22 in FIGS. 3 and 4. Seating portions 21 and 22 are offset axially from one another and are in opposite radial directions to its even J-slot seating portion counterparts 19 and 20. The odd set of J-slots accepts radially projecting, axially offset bulb retention pins 26 and 27 on the light bulb base 7' when the light bulb base 7' is inserted into socket 3 and turned counterclockwise such that the pins 26 and 27 rest in the seating portions 21 and 22, respectively.

In either the even or the odd J-slot configuration, each bulb retention pin (24, 25, 26 and 27) is positively supported by the corresponding seating portion (19, 20, 21 and 22).

In FIGS. 1 and 2, the socket 3 is shown in combination with a light bulb 5 having a single contact 11 with retention pins 24 and 25 extending from the opposite sides of the base 7 in radial and axial alightment. Electrical contact means 29 to a panel, board or wire 30 and yieldable support means 28 to urge the electrical contact means 29 against the contact 11 appear in the socket cavity 2 and would further urge retention pins 24 and 25 against seating portions 19 and 20, respectively.

In FIGS. 3 and 4, the socket 3 is shown in combination with a light bulb 5' having multiple contacts 12 with axially offset retention pins 26 and 27 extending from opposite sides of the base 7'. Electrical contact means 29' to a panel, board or wire 30' and yieldable support means 28 to urge the electrical contact means 29' against the contacts 12 appear in cavity 2' and would further urge retention pins 26 and 27 against seating portions 21 and 22, respectively.

In view of the foregoing it will be seen that the objects and advantages are attained.

Although embodiments of the invention have been disclosed and described, it is apparent that other embodiments and modifications of the invention are possible.

What is claimed is:

1. A lamp socket assembly capable of receiving either single or multicontact light bulbs having either a pair of axially aligned or a pair of axially offset radially projecting retention pins located on a light bulb base, the assembly including a socket having electrical contact means therein, and yieldable support means to support a light bulb and to urge the retention pins against the said socket comprising:

A cylindrical sleeve, open at one end to accept a light bulb base inserted therein having end stops means at the other end of said sleeve to engage said yieldable support means, said sleeve having two sets of diametrically disposed J-slots, separate sets to accept each of the retention pin pairs of either single or multicontact light bulbs.

2. A lamp socket in accordance with claim 1 comprising:

one set of even J-slots, wherein said even set of J-slots accept radially projecting, axially aligned pins on the lamp base when the lamp base is inserted into the socket and turned clockwise such that the pins rest in the seating portion of the even J-slot set, and one set of odd J-slots commonly sharing an entrance portion of the slots with the even set of J-slots, and with the seating portions of the odd J-slots being offset axially from one another and in opposite radial directions to its even J-slot counterparts, wherein said odd set of J-slots accept radially projecting axially offset pins on the lamp base when the bulb is inserted into the socket and turned counterclockwise such that the pins rest in the seating portion of the J-slots.

3. A lamp socket in accordance with claim 2 wherein each pair of retention pins on the base of an inserted light bulb are accepted by and are positively supported by both pins seated in their respective J-slots.

* * * * *